US006546560B2

(12) United States Patent
Fusco et al.

(10) Patent No.: US 6,546,560 B2
(45) **Date of Patent: *Apr. 15, 2003**

(54) FULL BODY SWIMSUIT

(75) Inventors: Ciro Fusco, Portland, OR (US); Armin Böhm, Nürnberg (DE)

(73) Assignee: adidas International B.V., Amsterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 10/175,936

(22) Filed: Jun. 20, 2002

(65) Prior Publication Data

US 2002/0152531 A1 Oct. 24, 2002

Related U.S. Application Data

(63) Continuation of application No. 09/513,048, filed on Feb. 24, 2000, now Pat. No. 6,484,319.

(51) Int. Cl.[7] ..... A41D 13/00

(52) U.S. Cl. ..... 2/67; 2/69; 2/227; 441/105

(58) Field of Search ..... 2/227.1, 228, 238, 2/69.79, 67, 70, 80.108, 243.1; 441/105, 120; 66/170, 171, 175, 176, 177, 178 A, 177 E; 450/115–118, 124–126, 19–21, 74–76; 602/60–66, 75–77

(56) References Cited

U.S. PATENT DOCUMENTS

| | | | | |
|---|---|---|---|---|
| 1,128,682 A | | 2/1915 | Homewood | |
| 1,535,481 A | | 4/1925 | Kjelgaard | |
| 1,839,489 A | | 1/1932 | Meroussis | |
| 2,550,327 A | | 4/1951 | Christensen | |
| 3,015,829 A | | 1/1962 | Gronkowski | |
| 3,286,287 A | | 11/1966 | Martin | |
| 3,786,526 A | | 1/1974 | Ausseil | |
| 3,975,929 A | | 8/1976 | Fregeolle | |
| 4,015,448 A | | 4/1977 | Knohl | |
| 4,153,050 A | | 5/1979 | Bishop et al. | |
| 4,176,665 A | | 12/1979 | Terpening | |
| 4,180,065 A | | 12/1979 | Bowen | |
| 4,311,135 A | | 1/1982 | Brueckner et al. | |
| 4,502,301 A | * | 3/1985 | Swallow et al. | 66/178 A |
| 4,502,473 A | | 3/1985 | Harris et al. | |
| 4,538,615 A | | 9/1985 | Pundyk | |
| 4,570,625 A | | 2/1986 | Harris et al. | |
| 4,654,894 A | | 4/1987 | Kudo | |
| 4,972,522 A | | 11/1990 | Rautenberg | |
| 4,999,845 A | | 3/1991 | Jenks, Jr. et al. | |
| 5,033,116 A | | 7/1991 | Itagaki et al. | |
| 5,052,053 A | | 10/1991 | Peart et al. | |
| 5,055,075 A | | 10/1991 | Waller, Jr. | |
| 5,139,475 A | | 8/1992 | Robicsek | |
| 5,161,257 A | | 11/1992 | Arensdorf et al. | |

(List continued on next page.)

OTHER PUBLICATIONS

Williams and Kooyman, (Sep./Oct. 1985) "Swimming Performance and Hydrodynamic Characteristics of Harbor Seals Phoca Vitulina," *Physiological Zoology*, vol. 58(5):576–589.

Sharp and Costill, (Oct. 1989) "Influence of Body Hair Removal on Physiological Responses During Breaststroke Swimming," *Medicine and Science in Sports and Exercise*, vol. 21(5):576–580.

Mendel, (Feb./Mar. 1994) "Dressed to Compress," *Athletic Management*, pp. 40, 42, and 44.

(List continued on next page.)

*Primary Examiner*—Gloria M. Hale
(74) *Attorney, Agent, or Firm*—Testa, Hurwitz & Thibeault, LLP

(57) ABSTRACT

This invention relates to a full body swimsuit for enhancing a swimmer's performance in the water. Swimming performance is enhanced by optimizing swimming efficiency, which include influencing the swimmer's physiological responses, improving the accuracy of the swimmer's movements, and optimizing the direction of the resultant propellant forces by modifying the propellant areas.

12 Claims, 7 Drawing Sheets

U.S. PATENT DOCUMENTS

| | | | |
|---|---|---|---|
| 5,282,277 | A | 2/1994 | Onozawa |
| 5,338,235 | A | 8/1994 | Lee |
| 5,359,732 | A | 11/1994 | Waldman et al. |
| 5,367,708 | A | 11/1994 | Fujimoto |
| 5,431,030 | A | 7/1995 | Ishizaki et al. |
| 5,546,955 | A | 8/1996 | Wilk |
| 5,603,232 | A | 2/1997 | Throneburg |
| 5,671,482 | A | 9/1997 | Alvera |
| 5,707,266 | A | 1/1998 | Arena |
| 5,768,703 | A | 6/1998 | Machado et al. |
| 5,787,509 | A | 8/1998 | Alvera |
| 5,826,761 | A | 10/1998 | Basaj |
| 5,894,970 | A | 4/1999 | Belkin et al. |
| 5,898,948 | A | 5/1999 | Kelly et al. |
| 5,994,612 | A | 11/1999 | Watkins |
| 5,996,120 | A | 12/1999 | Balit |
| 6,098,198 | A | 8/2000 | Jacobs et al. |
| 6,112,502 | A | 9/2000 | Frederick et al. |
| 6,314,584 | B1 | 11/2001 | Errera |

OTHER PUBLICATIONS

Weiss, (Aug. 6, 1997) "Can Lycra® Power Improve Your Performance?" About.com [Online], Available web site: http://bicycling.about.com/sports/bicycling/library/weekly/aa080697.htm?iam=ask&terms=lycra, Accessed on: Feb. 23, 2000.

Kraemer, et al, (1998) "Influence of a Compression Garment On Repetitive Power Output Production Before and After Different Types of Muscle Fatigue," *Sports Med., Training and Rehab.*, vol. 8(2):163–184.

adidas International B. V., (at least as early as Jun. 25, 1998) adidas Equipment Bodysuit: Press Information.

Collcutt and Lord, (Jul. 7, 1998) "All–over costume aims to put speed and style in the swim," *Times of London*.

Lord, (Jul. 15, 1998) "Putting the squeeze on in the fast lane," *Times of London*.

Parrack, (Aug. 1998), "ASA National Championships and Commonwealth Trials," *Swimming Times*, pp. 5 and 9.

Dolbow, (Oct. 1998) "The Score: The Look of Swim to Come?" *Sportstyle*, p. 7.

Feitelbert, (Oct. 15, 1998) "Sport Report: adidas Has Swimwear Covered," *Women's Wear Daily*, vol. 176(72):10.

adidas America, (date unknown) adidas Swim: "The Equipment Fullbody Suit," [Online] Available web site: http://adidas_america/publications/scoops/swim/swim.htm, Accessed on: Oct. 27, 1998.

Author unknown, (Nov. 1998) "Swim in Your adidas," *City Sports Magazine*.

Binole, (Nov. 20, 1998) "Swimmers hope to go faster with adidas suit," *The Business Journal*.

Binole, (Nov. 30, 1998) "This swimsuit won't make SI's cover," *Sports Business Journal*.

Author unknown, (Dec. 1998) Title Unknown, W.

Weede, (Dec. 1998) "Power Suits," *Sportstyle*.

Author unknown, (Dec. 14, 1998) "A Swimsuit Issue: Out of the Frying Pan" *Sports Illustrated*, p. 34.

adidas International B. V., (1999) Advertisement: Men's Apparel.

(Feb. 1999) "Slippery When Wet: Teflon Suit Takes The Drag Out of Swimming," *Aqua Magazine*, p. 14.

Torres, (May–Jun. 1999) "PulseFitness: Does it Work? Well Suited," *Rodale's Fitness Swimmer*.

McMorris, (Fall 1999) "Personal Trainer Great Gear: Does it WORK?" *Sports Illustrated For Women*, pp. 118–119.

Smith, (Nov. 22, 1999) "The Man with the Golden Feet," *Sports Illustrated*, 7 pages ending on page number 114.

Stromgren Supports, Inc., (1999–2000) Online history and product information, [Online] Available web site: http:www.stromgren.com/history.htm and http://www.stromgren. com/study.htm, Accessed on May 31, 2000.

adidas International, B. V. (Feb. 14, 2000) adidas Media Release: "The influence of proprioception?"

adidas International, B. V. (date unknown) adidas Equipment: "The Most Innovative adidas Products Based on the Athletes Needs Engineered For Performance": information on equipment bodysuit.

adidas International, B. V. (Sep. 4, year unknown) adidas Media Announcment: Photo Opportunity "adidas Equipment Fullbody Suit: adidas Revolutionizes Swimming."

adidas International, (date unknown) adidas Media Announcement: "Quick Swim Facts."

adidas International, B. V. (date unknown) adidas Media Announcement: "Technology Behind the Equipment Fullbody Suit."

DuPont (U.K.) Limited, (date unknown) "Lycra® Power Only by DuPont."

* cited by examiner

FULL BODY SWIMSUIT

CROSS-REFERENCE TO RELATED APPLICATION

This application is a continuation of U.S. patent application Ser. No. 09/513,048, which was filed on Feb. 24, 2000, now U.S. Pat. No. 6,484,319 the entire contents of which are hereby incorporated herein by reference.

FIELD OF THE INVENTION

This invention relates to a full body swimsuit for enhancing a swimmer's performance in the water. Swimming performance may be enhanced by optimizing swimming efficiency, which can be related to influencing the swimmer's physiological responses, improving the accuracy of the swimmer's movements, and optimizing the direction and magnitude of resultant propellant forces by modifying propellant areas of the swimsuit.

BACKGROUND OF THE INVENTION

Swimming by humans pertains to a non-rigid motile articulated body lacking specialized propellant surfaces moving in a liquid-gas interface. The human body is not particularly well-equipped or designed for swimming and, therefore, humans are typically highly inefficient swimmers. For example, when compared to a marine mammal, the drag coefficient of a towed human is several orders of magnitude larger than a towed seal (3.5 times larger), as described in "Swimming Performance and Hydrodynamic Characteristics of Harbor Seals," by Williams and Kooyman, *Phoca Vitulina. Physiol. Zool.,* 58:57689 (1985). In swimming, the "cost of transport" (i.e., the power expended per unit of distance covered) for humans is high.

To compare human swimmers to marine mammals, however, is misleading. Humans swim at the interface of a liquid-solid medium and are not equipped with any hydrodynamic propellers such as tails or pectoral fins. To swim, humans have to resort to a technique that involves a high production of turbulence and that is based on strict kinetic criteria (swimming technique). This is one of the reasons why humans require intensive training to improve their performance. Only through intensive training can good swimming technique (not natural to humans) be maintained and improved.

Because of human motility, human swimmers cannot be compared to a rigid object moving in a liquid medium, such as a torpedo. It is not clear, however, that reducing the drag coefficient and/or reducing form resistance would be more beneficial than reducing the "cost of transport" by improving swimming technique or reducing fatigue.

Optimization of efficiency can be achieved by influencing the parameters contributing to performance. Identifying appropriate parameters and quantifying their contribution are important for advancing athletic performance. In swimming, performance efficiency is largely related to resistive forces. Available theoretical models of swimming generally consider that three major types of resistive forces affect swimming: 1) frictional or surface resistance (skin friction), 2) form resistance (cross-sectional resistance), also referred to as Eddy resistance, and 3) wave making resistance.

Traditionally, swimmers have tried to reduce frictional resistance by removing body hair. See, for example, "Influence of Body Hair Removal on Physiological Responses During Breaststroke Swimming," by R. L. Sharp and D. L. Costill, *Medicine and Science in Sport Exercise*, Vol. 21, No. 5, 1989. Swimmers have also tried to reduce the Eddy resistance by assuming a swimming position that comes as close as possible to streamlining the body. As for wave making resistance, swimmers have tried to alter their swimming style by developing special techniques through intensive training.

However, no matter how well trained a swimmer is, fatigue can cause a swimmer to stray from good form and learned techniques and to be less precise in his movements, wasting energy on ineffective movements. Therefore, a need exists for an aid to swimmers that will assist them in maintaining proper swimming form and stave off fatigue by allowing the swimmers to be more effective and efficient with their movements.

Because of the low range of speeds and the differences in human swimming styles, laminar flow (i.e., fabric drag coefficient) is not considered the prominent relevant factor in swimming efficiency. As described in detail hereinbelow, influencing the physiology of the swimmers, optimizing the action of the propellant areas of the swimmers, and improving the accuracy of the swimmers' movements, rather than reducing the resistive forces, can lower the high cost of transport in human swimming.

SUMMARY OF THE INVENTION

A properly designed swimsuit can be used to improve a swimmer's efficiency in water. At a physiological level, the swimsuit enhances microcirculation of blood in the muscles by applying graduated compression at specific points of the body and in specific compression ranges.

On a cognitive level, the compression of the swimsuit provokes a proprioceptive reaction that enhances a swimmer's awareness and sensation of body posture and position in space. This awareness leads to more accurate biomechanical swimming movements and improved efficiency in swimming.

Alternatively or additionally, turbulence-directing protuberances positioned on propellant areas, for example, the forearms, and in specific patterns also enhance efficiency. The protuberances affect the turbulent flow created by the propellant surface, thus, efficiently redistributing propellant forces. Individually and collectively, these improvements work to promote swimming efficiency and reduce and inhibit fatigue.

According to one aspect of the invention, a full body swimsuit includes areas of graduated compression in a portion of the swimsuit. In one embodiment, the graduated compression can be in an arm portion and/or a leg portion of the swimsuit. In another embodiment, the arm portion of the swimsuit includes a wrist portion and a biceps portion. The compression in the arm portion can be greater at the wrist portion than at the biceps portion. In yet another embodiment, the graduated compression of the arm portion of the swimsuit is less than about 15 mm Hg.

In still another embodiment, the leg portion of the swimsuit includes an ankle portion and a thigh portion. The compression in the leg portion can be greater at the ankle than at the thigh portion. In still another embodiment, the graduated compression of the leg portion of the swimsuit can be between about 15 mm Hg to about 41 mm Hg. Alternatively, the graduated compression of the leg portion of the full body swimsuit can be between about 15 mm Hg to about 35 mm Hg.

In another aspect of the invention, a full body swimsuit includes a turbulence protuberance on a portion of the swimsuit. The protuberance creates a localized point of turbulence when swimming. In one embodiment, the portion of the swimsuit where the protuberance is found is a forearm portion of the swimsuit. The protuberance includes at least one raised element and may include a plurality of raised elements in a pattern such as an array.

In yet another aspect of the invention, a full body swimsuit includes, in combination, a graduated compression in a portion of the swimsuit and a turbulence protuberance in a portion of the swimsuit.

In still another embodiment, the full body swimsuit is made of a material that includes polyester fibers and elastic fibers.

These and other objects, along with advantages and features of the present invention herein disclosed, will become apparent to those skilled in the art through reference to the following description of various embodiments of the invention, the accompanying drawings, and the claims.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DETAILED DESCRIPTION OF THE INVENTION

Embodiments of the present invention are described below. It is, however, expressly noted that the present invention is not limited to these embodiments, but rather the intention is that all equivalents and modifications that are obvious to a person skilled in the art are also included.

Figure 1A:
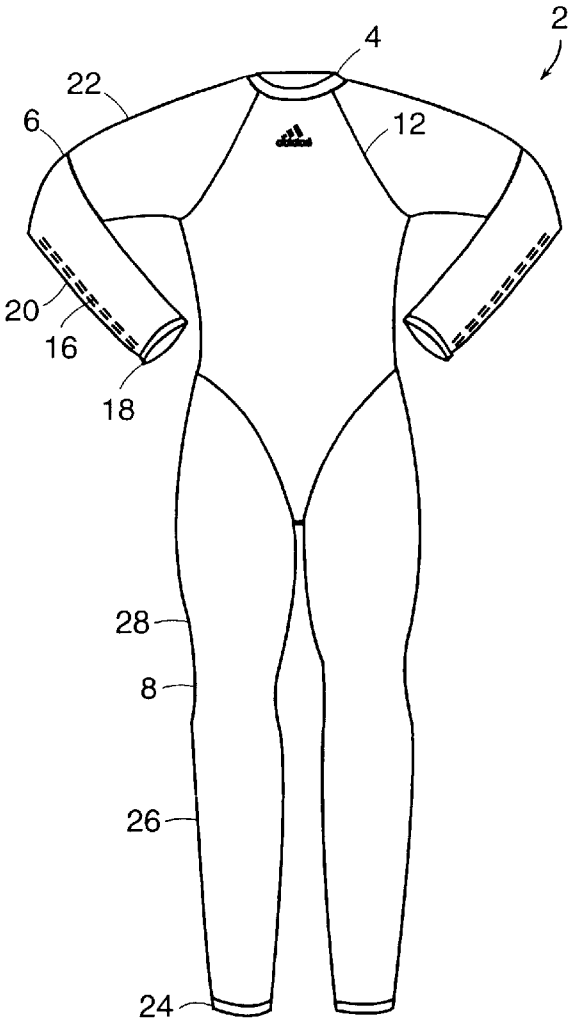
FIGS. 1A and 1B depict frontal and dorsal views, respectively, of one embodiment of the swimsuit of the present invention.
Figure 1B:
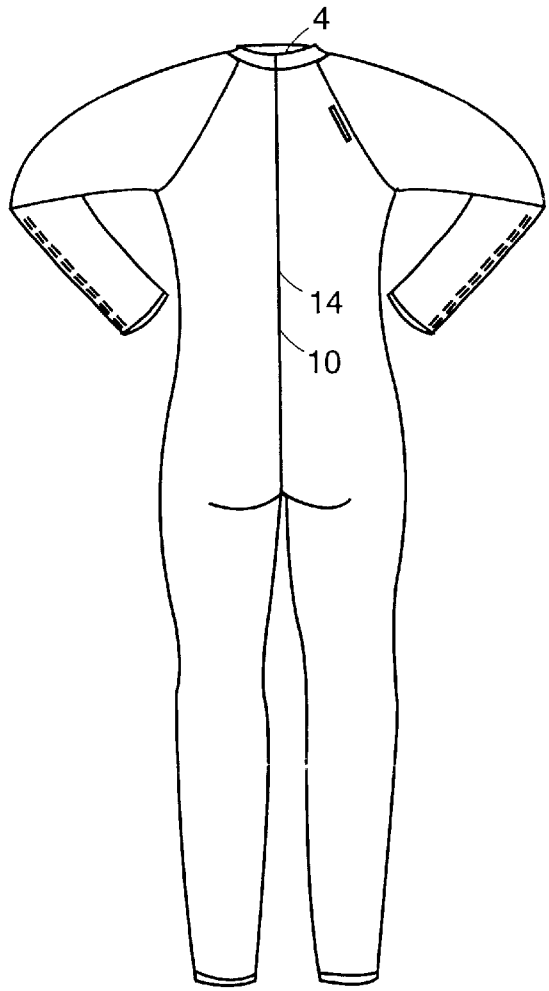

FIGS. 1A and 1B depict a frontal view and a dorsal view of one embodiment of the swimsuit of the present invention. The full body swimsuit 2 includes a neck portion 4, an arm portion 6, and a leg portion 8. The arm portion 6 includes a wrist portion 18, a forearm portion 20, and a biceps portion 22. The leg portion 8 includes an ankle portion 24, a lower leg portion 26, and a thigh portion 28.

The swimsuit 2 can be made of a polyester fiber and an elastic fiber, such as about 10% to 90% or more PA: Polyamid, for example, Meryl®, and about 90% to 10% or less EL: Elastan, for example, Lycra® Power, (E.I. du Pont de Nemours and Company, Wilmington, Del.) with an optional fabric finish such as Teflon® (E.I. du Pont de Nemours and Company, Wilmington, Del.). Lycra Power's major characteristics provide freedom of movement (high elongation), comfort in motion (flat stress strain curve), as well as a second-skin fit. The optional Teflon covering substantially precludes water penetration into the swimsuit.

The swimsuit 2 may be stitched using "flat lock" seams 12, which are soft, flat, and elastic, to provide more comfort than seams resulting from regular stitching. A zipper 14 on the back of the swimsuit 2 is also flat. The zipper 14 extends from about mid spine 10 to the neck 4 of the swimsuit 2. In this embodiment, optional turbulence protuberances 16 are located generally on the dorsal side of the forearm 20 of the swimsuit 2.

Figure 2:
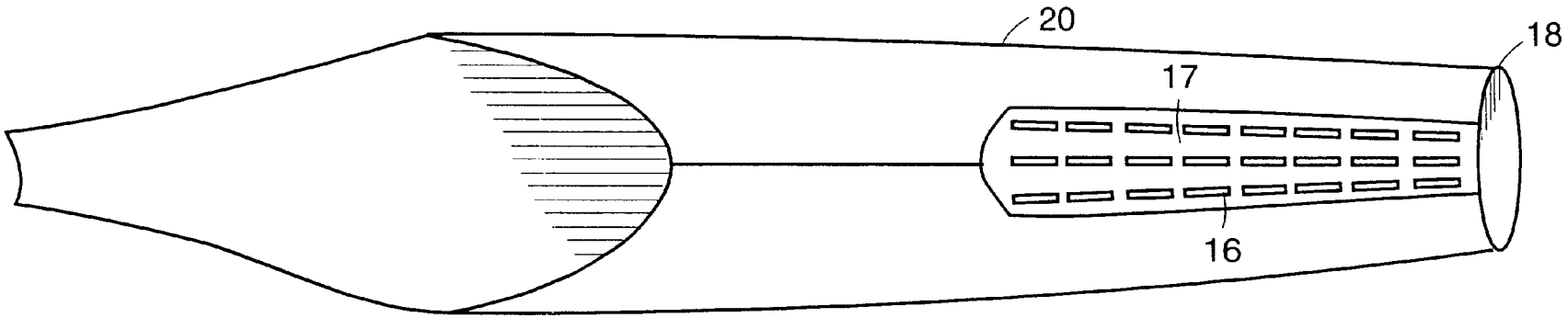
FIG. 2 depicts one embodiment of the turbulence protuberances of the present invention along a forearm portion of a sleeve.

FIG. 2 depicts a closer view of one embodiment of the turbulence protuberances 16. The protuberances 16 are generally on the medial side of the forearm 20. The protuberances 16 are raised elements used to localize the turbulence created by the swimmer as he takes a stroke.

The protuberances 16 can be made of, for example, a plastic material, a rubber material, or a material made from the combination of the two. An example of a material that can be used to create the protuberances is plastisol. The protuberances 16 can be applied by screen printing methods and, as depicted here, are in the form of discrete rectangular ribbings arranged in a 3×8 array. In one embodiment, the protuberances 16 can be about 1 inch in length, about $1/8^{th}$ of an inch in width, and about $1/32^{nd}$ of an inch in height. The protuberances 16 can be arranged lengthwise along the length of the forearm 20 of the swimsuit 2 with spaces 17 between the individual protuberances 16, along the width of the forearm 20 gradually decreasing as one moves towards the wrist 18. Other protuberance configurations include those that are cylindrical, square, trapezoidal, etc. and can be extended longitudinally and/or transversely in any combination and size along the propellant area of choice.

The protuberances 16 maximize and concentrate turbulence generated by the propellant area on the swimmer's forearms 20. Without the protuberances 16, there is turbulence around the entire forearm 20. The protuberances 16 increase the relative amount of turbulence in one location of the forearm 20, thereby offsetting or neutralizing the effect of the turbulence occurring on or around the other portions of the forearm 20. The direction of the resultant propellant force is thereby optimized.

Figure 3A:
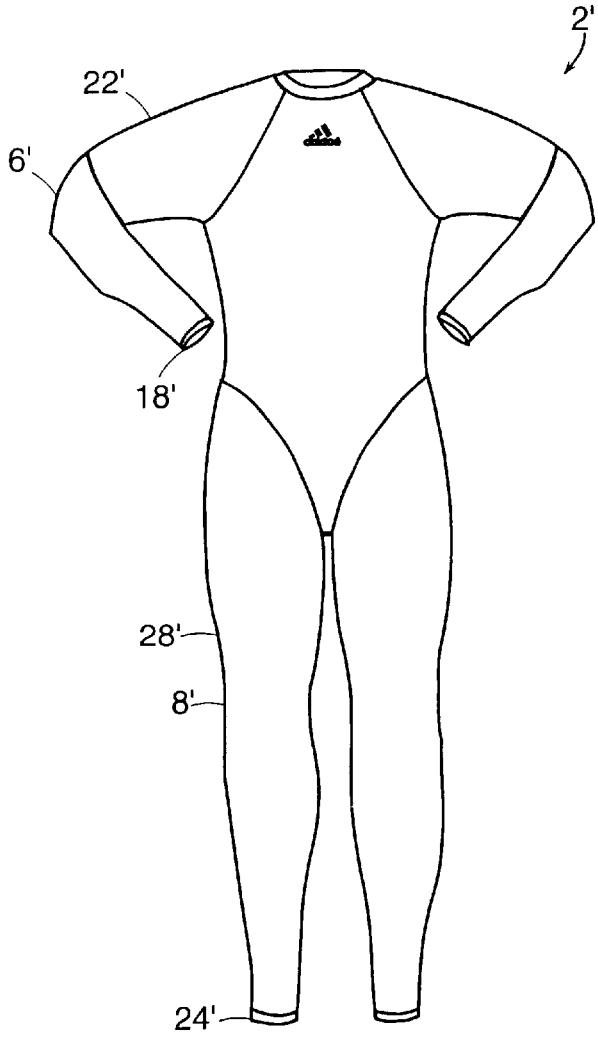
FIGS. 3A and 3B depict frontal and dorsal views, respectively, of another embodiment of the swimsuit of the present invention.
Figure 3B:
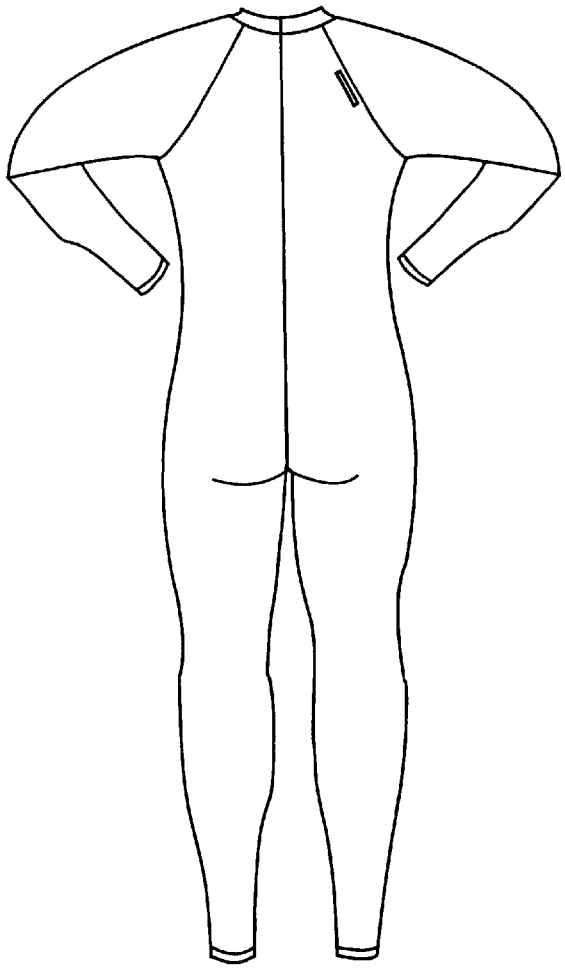

FIGS. 3A and 3B depict a frontal view and a dorsal view of another embodiment of the swimsuit of the present invention. The arms 6' and legs 8' of the swimsuit 2' are featured to provide graduated compression of the arms and legs. The wrists 18' and ankles 24' of the swimsuit 2' create the most compression on the limbs of a wearer, with the compression gradually decreasing in the swimsuit 2' as one travels towards the torso. In yet another embodiment, the compression gradually decreases from the wrists 18' and ankles 24' of the swimsuit 2' with minimal compression at the biceps 22' and thighs 28' of the swimsuit 2'.

Figure 4:
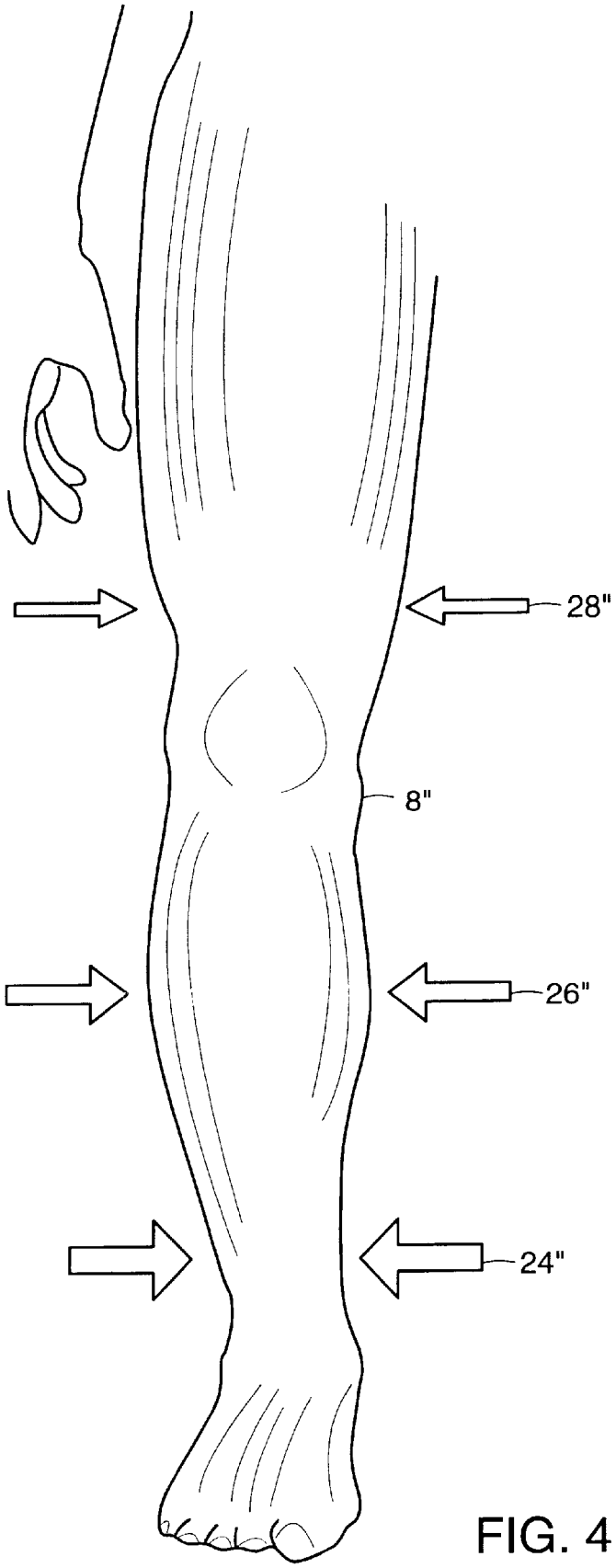
FIG. 4 is a schematic diagram of a pressure gradient profile as applied on a leg.

FIG. 4 is a pressure gradient profile of a leg 8" showing the relative compression that can be applied by one embodiment of the full body swimsuit of the present invention. The swimsuit 2' (as shown in FIGS. 3A and 3B) can apply a pressure gradient to leg muscle groups with a maximum compression at the ankle 24" and a minimum compression at the thigh 28", with an intermediate compression on the lower leg portion 26" therebetween. The level of compression in the legs can range from below medical compression (about 15 mm Hg) to a level of about 35–41 mm Hg in the medical compression range. This amount of compression is equivalent to a class CII–CIII medical stocking.

The swimsuit 2' can also apply a pressure gradient to the arm muscle groups (not shown), with the maximum compression at the wrist and minimum compression at the biceps, with an intermediate compression at the forearm portion therebetween. The level of compression on the arm muscle group may be below medical compression (about 15 mm Hg).

Figure 5:
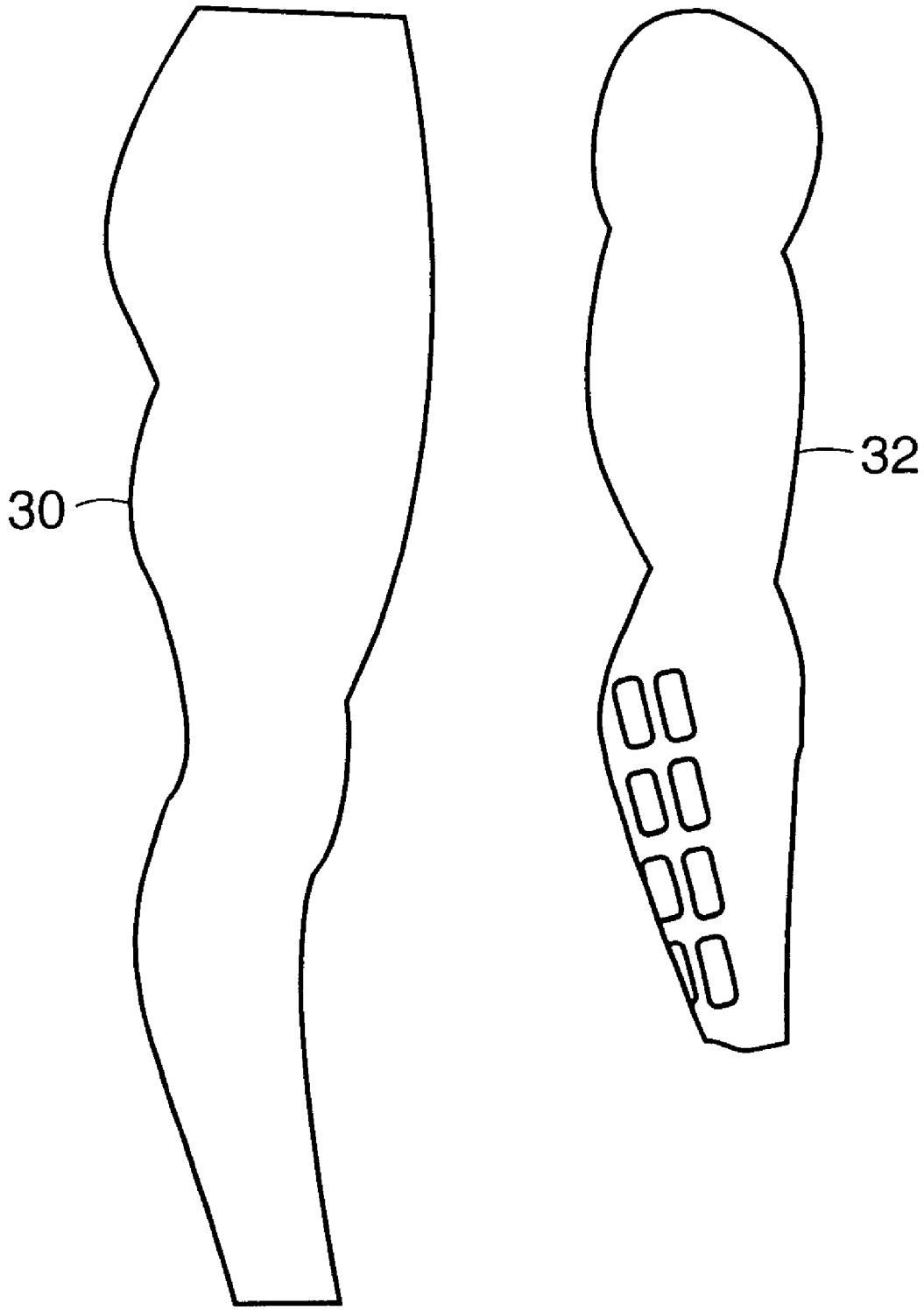
FIG. 5 depicts one pattern for creating the pressure gradient depicted in FIG. 4.

To achieve the desired level of compression, the swimsuit may be constructed using a special pattern design, an example of which is shown in FIG. 5. The leg 30 and arm 32 patterns have exaggerated contoured shapes that follow the shape of arms and legs when viewed laterally.

Figure 7:
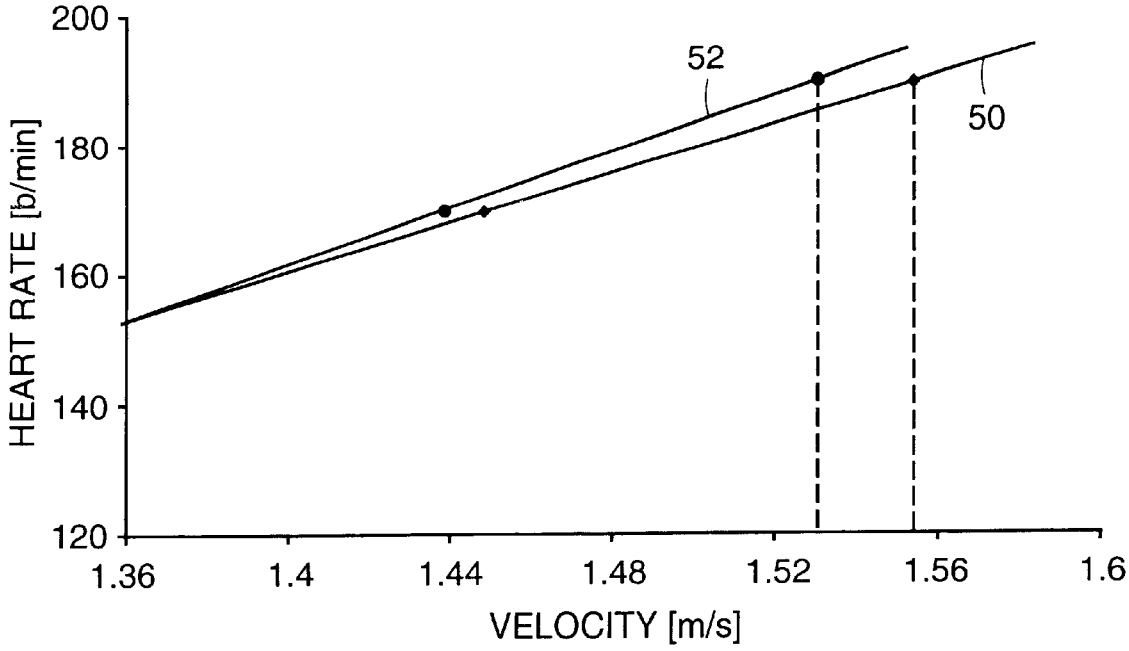
FIG. 7 shows a graph of the mean heart rate responses of test subjects in response to increasing swimming speeds while donning a fill body swimsuit in accordance with the invention, as compared to donning a conventional swimsuit.

The pressure gradient enhances microcirculation of the blood and improves proprioceptive response. Proprioception is defined in *Stedman's Medical Dictionary* (26$^{th}$ ed.), p.1439 (1995), as "[a] sense or perception, usually at a subconscious level, of the movements and position of the body and especially its limbs, independent of vision; this sense is gained primarily from input sensory nerve terminals in muscles and tendons (muscle spindles) and the fibrous capsule of joints combined with input from the vestibular apparatus." As one moves, these spindle-shaped sensors in the muscles inform the brain of what each part of the body is doing, and where it is in relation to other parts of the body. The brain develops its own "map" of the body, drawn from this flood of sensations. With every action, one "resculpts" and redefines his own body shape and orients it in space. The compression effect and the form-fitting design of the garment improve the feedback that receptors in the skin, muscles, and joints send to the brain creating a greater awareness of one's movements and, thus, leading to more precise, effective, and efficient movements. p In addition, a pressure gradient can also help increase the venous return of blood to the heart. Results from a physiological test comparing the full body swimsuits according to the invention to conventional swimsuits are described in Example 1 below. FIG. 7 shows the improved heart rate response of swimmers wearing the full body swimsuit as compared to conventional swimsuit. Further, the fine structure of the Lycra® Power material creates a feeling of smoothness similar to shaved human skin, thus, psychologically aiding the swimmer.

Figures 8A, 8B:
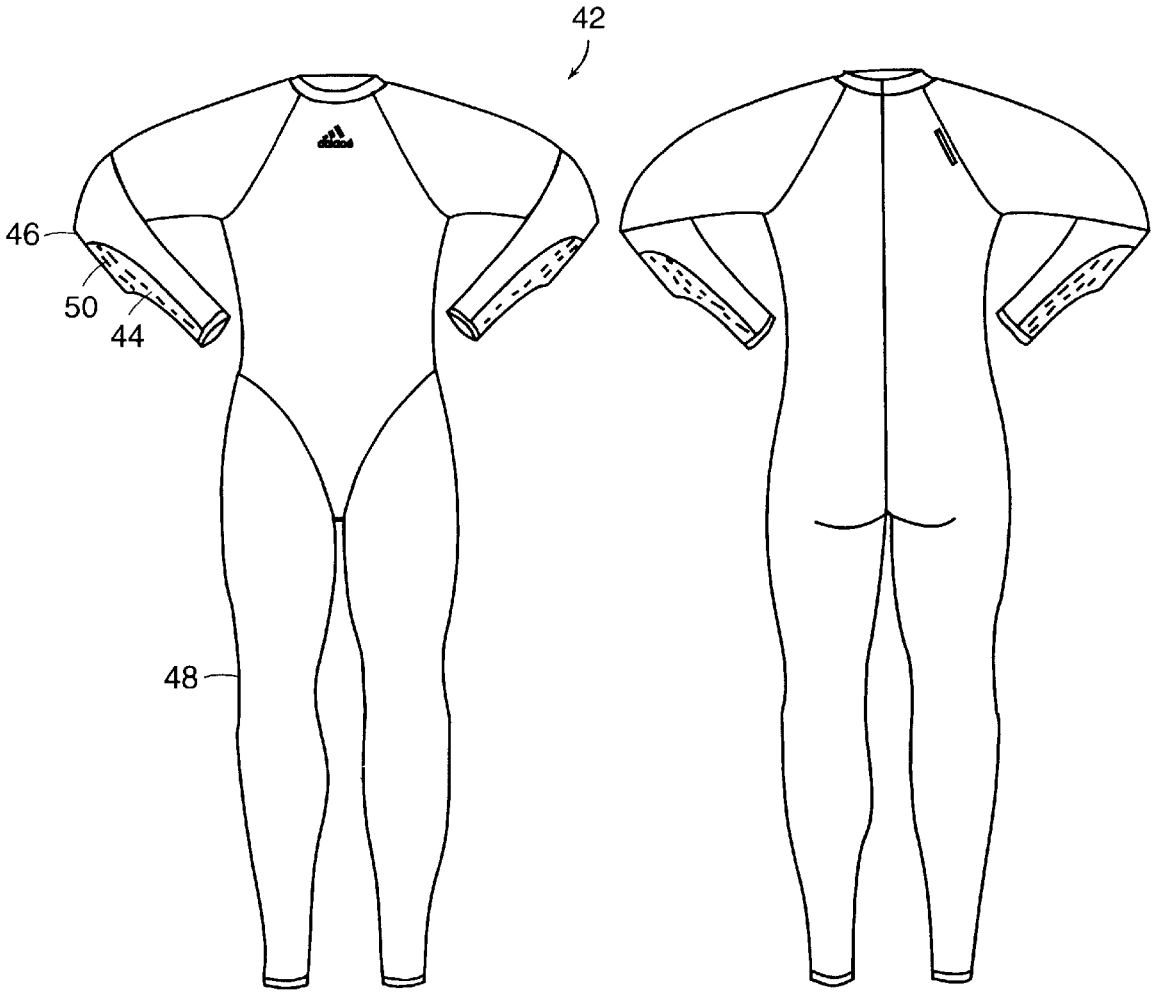
FIGS. 8A and 8B depict frontal and dorsal views, respectively, of yet another embodiment of the swimsuit of the present invention.

FIGS. 8A and 8B depict a frontal view and a dorsal view of yet another embodiment of the swimsuit of the present invention. The swimsuit 42 combines turbulent protuberances 44 in the forearm portions 50 with graduated compression of the arms 46 and legs 48 of the swimsuit 42.

EXAMPLE 1

The full body swimsuit according to present invention was tested against a conventional swimsuit. One objective was to demonstrate enhanced performance due to the full body swimsuit.

Methodology 13 male swimmers participated in this test. The test protocol was the same as conventionally used for swimming efficiency evaluations, as discussed further below. The test included a series of evaluations; however, only physiological demand and swimming efficiency results are discussed here. The heart rate of each swimmer was monitored between progressively faster trials over 200 meters. The speed rate was increased after each trial in order to achieve a substantially linear increase in the heart rate.

Figure 6:
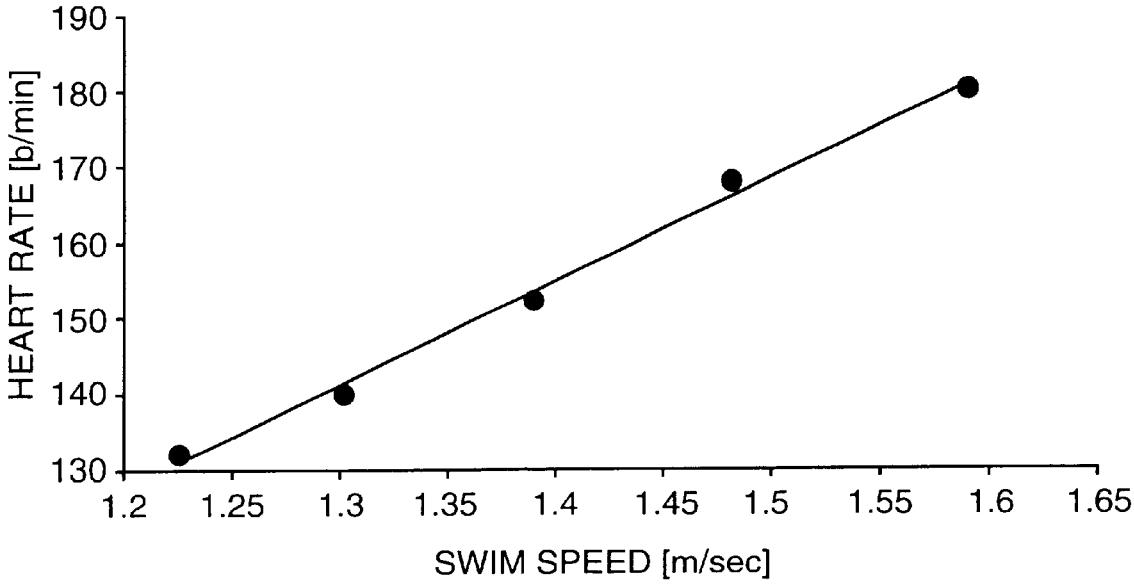
FIG. 6 shows a graph of the typical heart rate of a swimmer in response to increasing swimming speed.

The average swimming speed was sub-maximal and comparable to a typical speed occurring in a 400-meter training session. A typical heart rate response for an individual swimmer is shown in FIG. 6. Under these conditions, one can compare the physiological cost as determined by velocity at maximum heart rate. In other words, each swimmer was brought close to his maximum heart rate in the full body swimsuit and then in a conventional swimsuit, while measuring the swimming speed. If the full body swimsuit aids a swimmer in swimming more efficiently, one would expect a slower heart rate when the swimmer is wearing a full body swimsuit than when wearing the conventional swimsuit at the same swimming speed (i.e., less expenditure of energy in the full body swimsuit is needed to attain the same swimming speed). The fact that the swimmer was brought closer to his maximum heart rate ensured that his effort was the same when swimming in the full body swimsuit and the conventional swimsuit. Once the linear relation had been established, the speed at maximum heart rate was extrapolated.

Results

The results are plotted in FIG. 8. From the graph, it is clear that, at a maximum heart rate, the swimming speed was higher with the full body swimsuit, plotted as line 50, as compared to that with the conventional swimsuit, plotted as line 52. The gain has been extrapolated to be in the order of 1.5% (1.554 m/s with the full body swimsuit versus 1.531 m/s with the conventional swimsuit). This result can be regarded as a conservative estimate for a sub-maximal velocity typically obtained in training sessions over 400 meters. It is contemplated that, at higher speeds (as in a 200 meter race or a 100 meter race) and with elite athletes, the percent speed gain may be greater than 1.5%.

Having described preferred and exemplary embodiments of the invention, it will be apparent to those of ordinary skill in the art that other embodiments incorporating the concepts disclosed herein can be used without departing from the spirit and scope of the invention. The described embodiments are to be considered in all respects only as illustrative and not restrictive. For example, swimsuits according tot he invention may include protuberances in other regions of the arms and/or legs. Also, the swimsuit may extend only partially down the arms or legs, terminating at any point between the shoulder and wrist and/or hip or ankle. Further, the disclosures of all the references discussed herein are incorporated by reference in their entirety.

What is claimed is:

1. A full body swimsuit comprising:

an arm portion having a region of graduated compression;

a leg portion having a region of graduated compression; and a turbulence protuberance on at least one of the arm portion and the leg portion, wherein the turbulence protuberance creates a localized point of turbulence during swimming.

2. The swimsuit of claim 1, wherein the arm portion comprises a wrist portion and a biceps portion and the graduated compression is greater at the wrist portion than at the biceps portion.

3. The swimsuit of claim 2, wherein maximum compression is less than about 15 mm Hg.

4. The swimsuit of claim 1, wherein the leg portion comprises an ankle portion and a thigh portion and the graduated compression is greater at the ankle portion than at the thigh portion.

5. The swimsuit of claim 4, wherein maximum compression is less than about 41 mm Hg.

6. The swimsuit of claim 4, wherein maximum compression is less than about 35 mm Hg.

7. The swimsuit of claim 1, wherein the arm portion comprises a forearm portion and the turbulence protuberance is on the forearm portion.

8. The swimsuit of claim 7, wherein the turbulence protuberance is on at least one of a dorsal side and a medial side of the forearm portion.

9. The swimsuit of claim 1, wherein the turbulence protuberance comprises at least one raised element.

10. The swimsuit of claim 1, wherein the turbulence protuberance comprises an array of raised elements.

11. The swimsuit of claim 1, wherein a turbulence protuberance material is selected from the group consisting of a plastic, a rubber, and a combination thereof.

12. The swimsuit of claim 1 wherein the swimsuit is made of a material comprising a plastic fiber and an elastic fiber.

* * * * *